US010550703B2

(12) United States Patent
Goroshchak et al.

(10) Patent No.: US 10,550,703 B2
(45) Date of Patent: Feb. 4, 2020

(54) LOCKING SPACER FOR ROTOR BLADE

(71) Applicant: DOOSAN HEAVY INDUSTRIES & CONSTRUCTION CO., LTD., Changwon-si, Gyeongsangnam-do (KR)

(72) Inventors: Iurii Goroshchak, Gimhae-si (KR); Joohwan Kwak, Changwon-si (KR)

(73) Assignee: Doosan Heavy Industries Construction Co., Ltd., Gyeongsangnam-do (KR)

( * ) Notice: Subject to any disclaimer, the term of this patent is extended or adjusted under 35 U.S.C. 154(b) by 151 days.

(21) Appl. No.: 15/812,491

(22) Filed: Nov. 14, 2017

(65) Prior Publication Data

US 2018/0179902 A1 Jun. 28, 2018

(30) Foreign Application Priority Data

Dec. 23, 2016 (KR) ..... 10-2016-0177615

(51) Int. Cl.
*F01D 5/32* (2006.01)
*F01D 5/30* (2006.01)

(52) U.S. Cl.
CPC ..... *F01D 5/32* (2013.01); *F01D 5/303* (2013.01); *F01D 5/3038* (2013.01); *F05D 2230/60* (2013.01); *F05D 2260/30* (2013.01)

(58) Field of Classification Search
CPC . F01D 5/32; F01D 5/303; F01D 5/027; F01D 5/3038; F01D 5/326; F01D 5/323; F05D 2260/30

(Continued)

(56) References Cited

U.S. PATENT DOCUMENTS 6,929,453 B2 8/2005 Kite et al.
8,714,929 B2 5/2014 Joshi et al.

(Continued)

FOREIGN PATENT DOCUMENTS

JP 2011-226475 A 11/2011
KR 10-2007-0009391 A 1/2007

(Continued)

OTHER PUBLICATIONS

European Search Report dated May 4, 2018 in European Application No. 17203225.2-1006.

(Continued)

*Primary Examiner* — Dwayne J White
*Assistant Examiner* — Wesley Le Fisher
(74) *Attorney, Agent, or Firm* — Invenstone Patent, LLC

(57) ABSTRACT

A locking spacer, which is fitted in a dovetail slot provided on an outer circumferential surface of a disk put on a rotor shaft, includes: a pair of first blocks each provided with a dovetail joint, and configured to have a size occupying a portion of an internal space of the dovetail slot; a pair of second blocks having a size occupying a portion of the internal space of the dovetail slot, the portion not being occupied by the pair of first blocks, and each being provided with a locking groove; and a locking block having a size occupying a portion of the internal space of the dovetail slot, the portion not being occupied by the first and second blocks, and being provided with a rotating locking arm configured such that opposite end portions thereof are inserted into the locking grooves.

20 Claims, 7 Drawing Sheets

(58) Field of Classification Search
USPC ..... 416/220 R, 215
See application file for complete search history.

(56) References Cited

U.S. PATENT DOCUMENTS

| | | | | |
|---|---|---|---|---|
| 2005/0129522 | A1* | 6/2005 | Kite | F01D 5/32<br>416/220 R |
| 2005/0254950 | A1* | 11/2005 | Mons | F01D 5/06<br>416/201 R |
| 2006/0228216 | A1* | 10/2006 | Bachofner | F01D 5/3038<br>416/215 |
| 2009/0016889 | A1* | 1/2009 | Krutzfeldt | F01D 5/3038<br>416/204 R |
| 2011/0255978 | A1* | 10/2011 | Potter | F01D 5/3038<br>416/204 A |
| 2012/0114490 | A1* | 5/2012 | Joshi | F01D 5/303<br>416/220 R |
| 2015/0101346 | A1* | 4/2015 | Foster | F01D 5/303<br>60/805 |
| 2015/0101348 | A1* | 4/2015 | Hansen | F01D 5/303<br>60/805 |

FOREIGN PATENT DOCUMENTS

| | | | |
|---|---|---|---|
| KR | 10-2014-0068077 | A | 6/2014 |
| WO | WO-2016/195657 | A1 | 12/2016 |

OTHER PUBLICATIONS

Office Action dated Jan. 2, 2018 in Korean Application No. 10-2016-0177615.

* cited by examiner

LOCKING SPACER FOR ROTOR BLADE

CROSS-REFERENCE TO RELATED APPLICATION

This application claims the benefit of Korean Patent Application No. 10-2016-0177615, filed Dec. 23, 2016, the disclosure of which is hereby incorporated by reference in its entirety.

BACKGROUND OF THE DISCLOSURE

Field of the Disclosure

The present disclosure relates generally to a locking spacer for a rotor blade. More particularly, the present disclosure relates to a locking spacer that is finally fitted in a dovetail slot provided on an outer circumferential surface of a disk put on a rotor shaft in the process of alternate mounting of a blade and a spacer in the dovetail slot.

Description of the Background Art

Generally, a turbine is a mechanical device that obtains torque by impulsive force or reaction force using flow of a compressible fluid such as steam or gas. It is called as a steam turbine when steam is used and a gas turbine when combustion gas is used.

A thermodynamic cycle of the gas turbine is the Brayton cycle, and the gas turbine is constituted by a compressor, a combustor, and a turbine. The operation principle of the gas turbine comprises the following four steps: compression, heating, expansion, and heat dissipation. That is, the air in the atmosphere is drawn first, compressed by the compressor, then sent to the combustor to generate high temperature and high pressure gas to drive the turbine, and the exhaust gas is discharged to the atmosphere.

The compressor of the gas turbine serves to draw air from the atmosphere and supply combustion air to the combustor, and the combustion air is subjected to an adiabatic compression process, so that the pressure and the temperature of the air are increased.

In the combustor, the compressed air is mixed with fuel and is burned under equal pressure to produce high energy combustion gas of high energy, and to increase efficiency, the combustion gas temperature is increased to the heat resistance limit that the combustor and turbine components can withstand.

In the gas turbine, the high temperature and high pressure combustion gas from the combustor is expanded, and it is converted into mechanical energy by applying the collision reaction force to rotating blades of the turbine. The mechanical energy obtained from the turbine is supplied to the compressor required to compress the air and the remainder is used to drive a generator to produce power.

Since the gas turbine has no reciprocating motion in major components, there is no mutual friction part like a piston-cylinder, whereby consumption of lubricating oil is extremely small, amplitude which is characteristic of reciprocating machine is greatly reduced, and high speed movement is possible.

In the turbine of the steam turbine and the turbine and the compressor of the gas turbine, a rotor shaft rotating at a high speed is supported by bearings, and a plurality of disks having holes in the centers thereof are inserted and fixed in the turbine shaft. A plurality of rotating blades is arranged along the outer circumferential surface of each disk. Turbine blades serve to convert high-temperature and high-pressure steam or combustion gas energy into rotary motion, while compressor blades serve to continuously pressurize the intake air.

FIGS. 1 to 4 are views showing a method of mounting a blade along the outer circumferential surface of a disk. The method is that the blade and a spacer are alternately fitted in a dovetail slot formed along the outer circumferential surface of the disk. A dovetail joint having a shape complementary to the shape of the dovetail surface is formed in the lower portion of the base of the blade and in the spacer.

Referring to the assembly process in FIGS. 1 to 4, with the blade or the dovetail joint of the spacer facing the circumferential direction of the dovetail slot, that is, with the dovetail joint angled at 90 degrees with respect to opposite sides of the dovetail slot, the blade and the spacer are inserted into the dovetail slot, and in this state, the blade and the spacer are rotated at 90 degrees angle such that the dovetail joint is fitted into the dovetail slot.

The dovetail joint of the blade and the spacer with respect to the dovetail slot has a slight clearance and gap in the radial direction so that the blade and the spacer can be rotated at 90 degrees angle in the dovetail slot, and a spring plate (not shown) is provided in a groove formed in the bottom surface of the dovetail slot so as to push the blade and the spacer out of the radial direction to bring the dovetail joint into contact with the dovetail slot. Since centrifugal force is applied on the blade and the spacer when the rotor shaft is rotated, the clearance and gap in the radial direction do not affect the operation of the turbine engine.

The blade and the spacer are assembled alternately in the dovetail slot one by one. The last assembled spacer cannot be engaged in the dovetail slot by rotating it at 90 degrees angle in the dovetail slot because the space remaining in the dovetail slot is exactly the same as the size of the spacer. Accordingly, the last assembled spacer should have a specific structure that can be assembled without being rotated in the dovetail slot. For this reason, the last assembled spacer is called a locking spacer.

Fundamentally, the locking spacer should be able to be engaged in the opposite sides of the dovetail slot without being rotated, and the assembly structure should be simple, robust, and easy to disassemble for maintenance.

The foregoing is intended merely to aid in the understanding of the background of the present disclosure, and is not intended to mean that the present disclosure falls within the purview of the background art that is already known to those skilled in the art.

DOCUMENTS OF RELATED ART (Patent Document 1) Korean Patent Application Publication No. 2007-0009391 (published Jan. 18, 2007)

(Patent Document 2) Korean Patent Application Publication No. 2014-0068077 (published Jun. 5, 2014)

SUMMARY OF THE DISCLOSURE

Accordingly, the present invention has been made keeping in mind the above problems occurring in the related art, and the present disclosure provides a locking spacer, which is finally assembled with the dovetail slot of the disk, having a structure that is simple, robust, and easy to disassemble for maintenance.

According to some aspects of the present disclosure, there is provided a locking spacer, which is fitted in a dovetail slot provided on an outer circumferential surface of a disk put on a rotor shaft, the locking spacer including: a pair of first blocks each provided with a dovetail joint having a shape corresponding to a shape of a dovetail surface provided on each of axial opposite sides of the dovetail slot, and configured to have a size occupying a portion of an internal space of the dovetail slot; a pair of second blocks having a size occupying a portion of the internal space of the dovetail slot, the portion without being occupied by the pair of first blocks, and each being provided with a locking groove; and a locking block having a size occupying a portion of the internal space of the dovetail slot, the portion without being occupied by the first and second blocks, and being provided with a rotating locking arm configured such that opposite end portions thereof are inserted into a pair of the locking grooves.

Further, each of the first blocks may be provided with an inwardly stepped accommodation portion at a lower surface thereof, and each of the second blocks may be provided with a protruding portion at a lower surface thereof to be engaged with the accommodation portion.

Further, each of the first blocks may be provided with a first guide protrusion on a side opposite to the dovetail joint of axial opposite sides thereof along a radial direction, and each of the second blocks may be provided with a first guide groove corresponding to the first guide protrusion.

Further, each of the second blocks may be provided with a second guide protrusion, and the locking block may be provided with second guide grooves corresponding to the second guide protrusions.

Further, the locking arm may be connected to a rotating rod with a head thereof exposed to an upper surface of the locking block, and the locking arm may be engaged with or disengaged from the locking grooves by a rotation of the rotating rod.

In an embodiment of the present disclosure, the rotating rod may be a hexagon socket rod.

Further, the opposite end portions of the locking arm may be formed to have arc-shaped curved surfaces, and entrances of the locking grooves may be formed to be arc-shaped.

Further, each of the locking grooves may include a contact surface with which a side surface of the locking arm is brought into contact when the locking arm is angled at 90 degrees with respect to the second blocks.

Further, the head of the rotating rod exposed to the upper surface of the locking block may include an indicator indicating a direction along the opposite end portions of the locking arm.

Further, the locking block may be provided with a penetrating portion at a portion of an area thereof without being provided with the locking arm.

Meanwhile, the present disclosure provides a blade disk assembly configured such that a blade and a spacer are alternately inserted into a dovetail slot provided on an outer circumferential surface of a disk put on a rotor shaft, wherein the blade and the spacer are inserted into the dovetail slot in a state where dovetail joints of both the blade and the spacer are at an angle of 90 degrees to opposite sides of the dovetail slot, and then the blade and the spacer are rotated at 90 degrees angle, such that the dovetail joints are fitted in the dovetail slot, wherein the blade and the spacer are assembled alternately into the dovetail slot one by one, and finally a locking spacer for a rotor blade is engaged in a remaining space of the dovetail slot.

Further, the present disclosure provides a method for assembling a locking spacer for a rotor blade, in which a blade and a spacer are alternately inserted into a dovetail slot provided on an outer circumferential surface of a disk put on a rotor shaft, wherein the blade and the spacer are inserted into the dovetail slot in a state where dovetail joints of both the blade and the spacer are at an angle of 90 degrees to opposite sides of the dovetail slot, then the blade and the spacer are rotated at 90 degrees angle, such that the dovetail joints are fitted in the dovetail slot, the blade and the spacer are assembled alternately into the dovetail slot one by one, and finally the locking spacer according to any one of claims 1 to 13 is engaged in a remaining space of the dovetail slot, the method comprising: engaging the dovetail joint of each of the pair of first blocks with a dovetail surface provided on each of axial opposite sides of the dovetail slot to be fitted thereinto; inserting the pair of second blocks into the portion of the internal space of the dovetail slot, the portion without being occupied by the pair of first blocks, and bring the first blocks and the second blocks into contact with the dovetail surface; inserting the locking block into the portion of the internal space of the dovetail slot, the portion without being occupied by the first and second blocks; and inserting the opposite end portions of the locking arm into the locking grooves formed in the pair of second blocks by rotating the locking arm provided in the locking block.

The locking spacer of the present disclosure configured as described above is advantageous in that since it is constituted by separate bodies, that is, the first blocks, the second blocks, and the locking block, it is possible to assemble the locking spacer by inserting the same into the dovetail slot in a radial direction, and it is possible to easily assemble by fitting through the guide structure of the protrusion and the groove.

Further, since the locking spacer of the present disclosure can be assembled and disassembled by rotating the locking arm provided in the locking block at 90 degrees angle, it is possible to facilitate manufacturing the disk, and also it is convenient in terms of maintenance.

BRIEF DESCRIPTION OF THE DRAWINGS

The above and other features of the present disclosure will be more clearly understood from the following detailed description when taken in conjunction with the accompanying drawings, in which.

DETAILED DESCRIPTION OF THE DISCLOSURE

Figure 1:
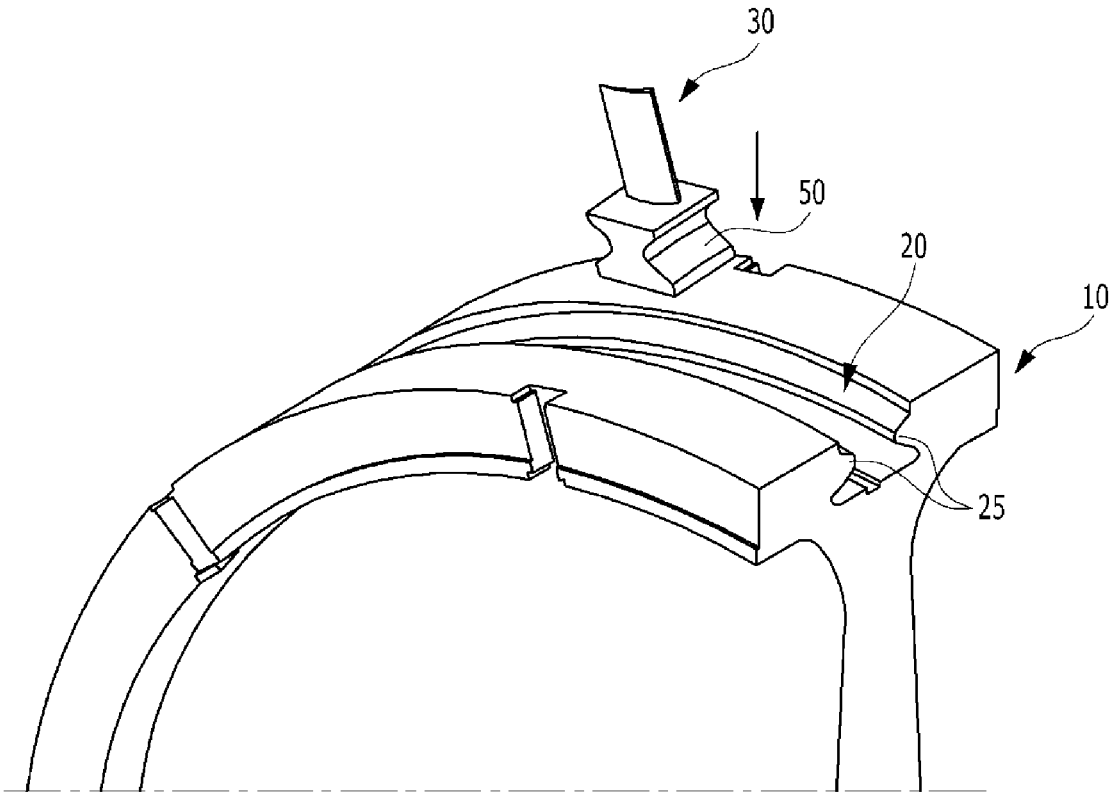
FIGS. 1 to 4 are views showing a process of alternate mounting of a blade and a spacer in a dovetail slot of a disk.
Figure 2:
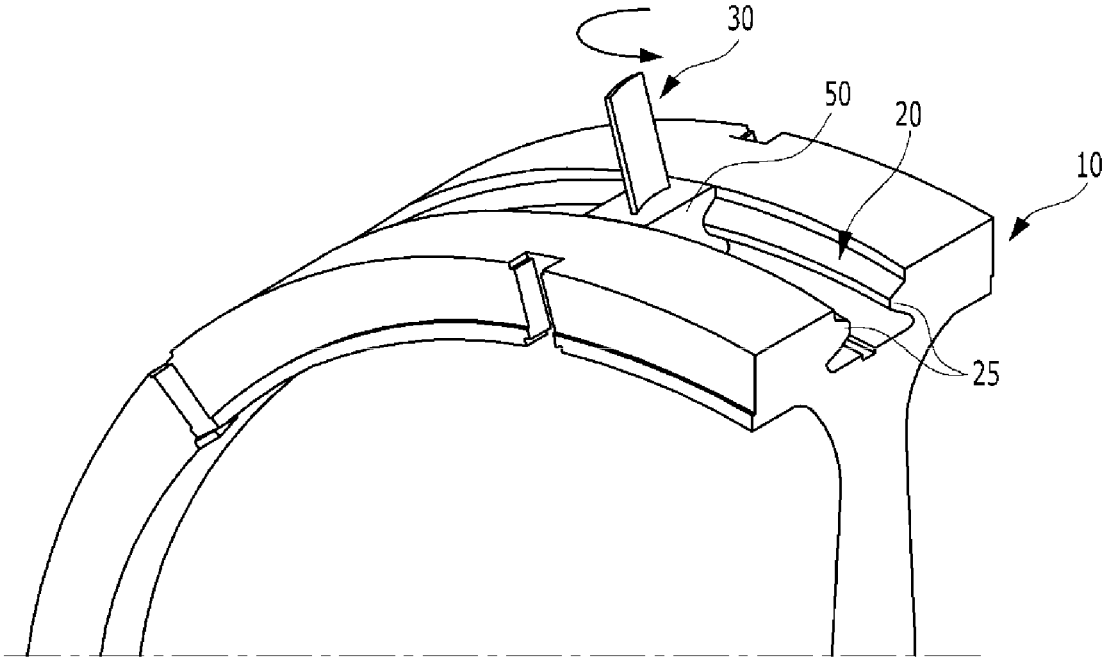
Figure 3:
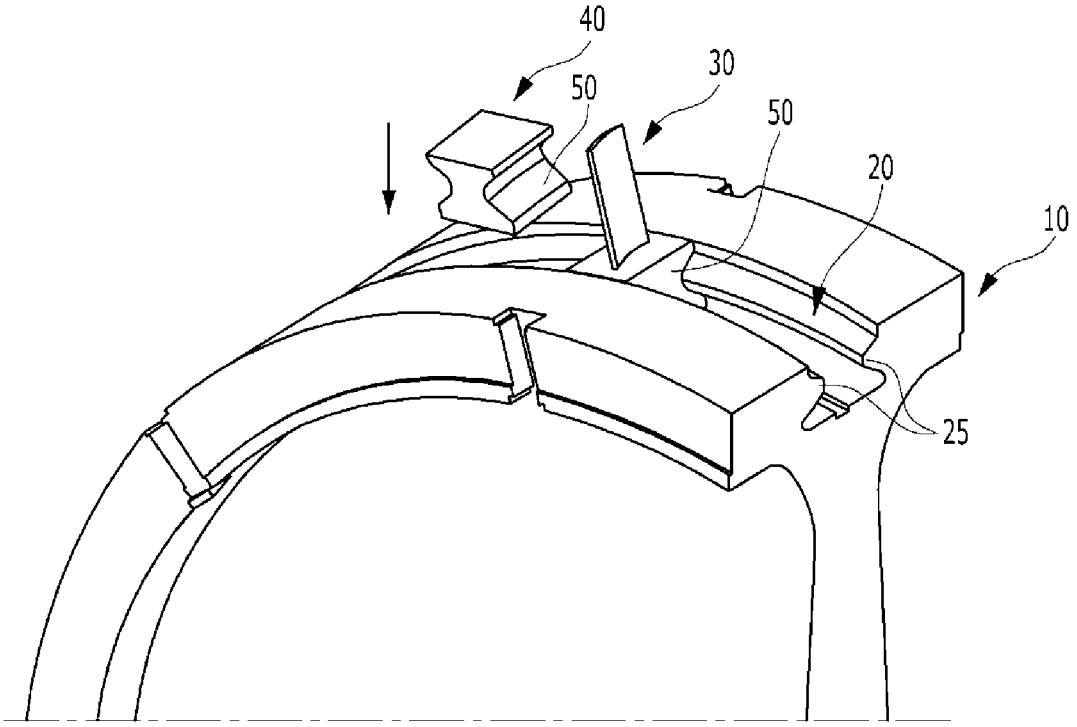
Figure 4:
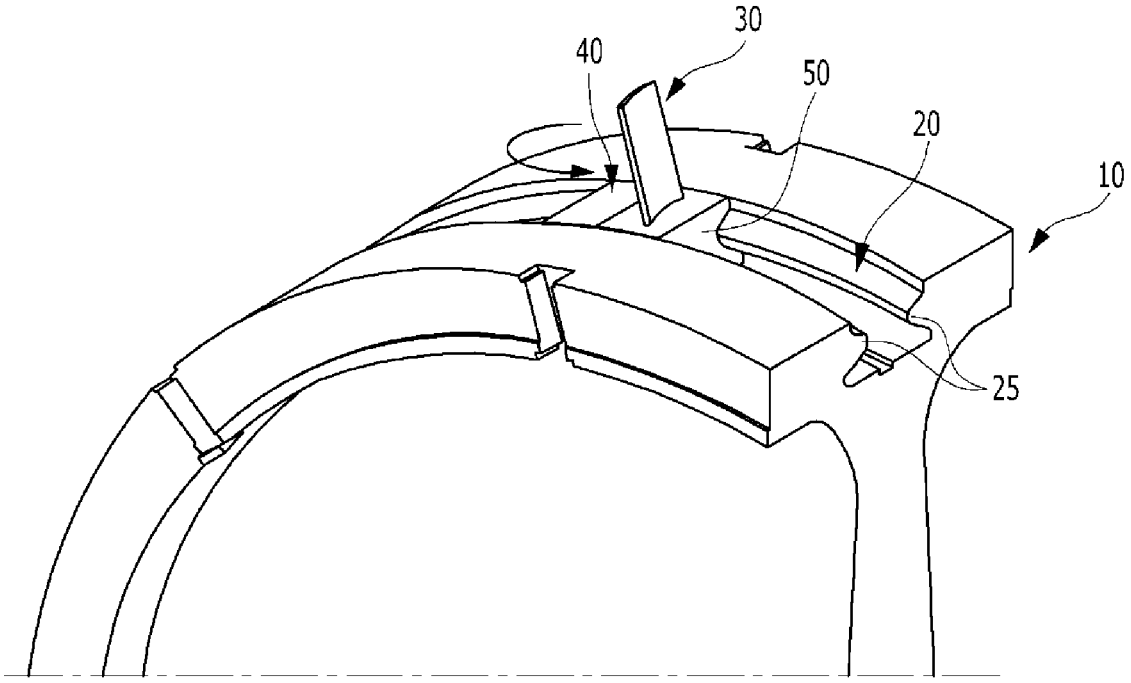

Reference will now be made in greater detail to a preferred embodiment of the disclosure, an example of which is illustrated in the accompanying drawings. Wherever possible, the same reference numerals will be used throughout the drawings and the description to refer to the same or like parts. In the following description, it is to be noted that, when the functions of conventional elements and the detailed description of elements related with the present disclosure may make the gist of the present disclosure unclear, a detailed description of those elements will be omitted.

Further, terms such as "a first~", "a second~", "A", "B", "(a)", and "(b)" are used only for the purpose for distinguishing a constitutive element from other constitutive element, but constitutive elements should not be limited to a manufacturing order, and the terms described in the detailed description of the invention may not be consistent with those described in the claims. It will be understood that when an element is referred to as being "coupled" or "connected" to another element, it can be directly coupled or connected to the other element or intervening elements may be present therebetween.

Figure 5:
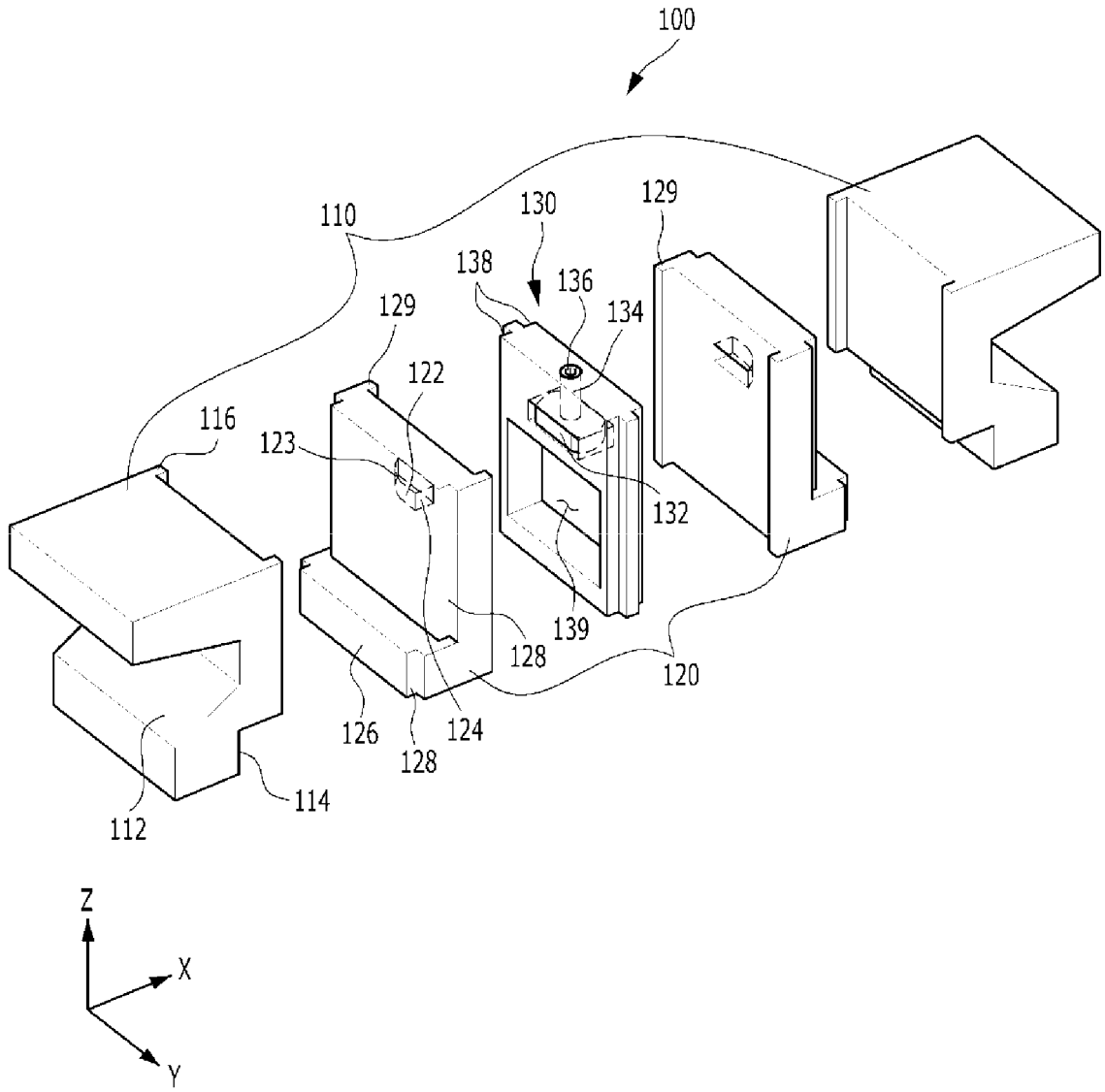
FIG. 5 is a detailed perspective view showing a structure of a locking spacer according to the present disclosure.

FIG. 5 is a detailed perspective view showing a structure of a locking spacer according to the present disclosure, and a detailed description will be made with reference thereto. Herein, in describing the present disclosure, considering that a direction in which a locking spacer 100 is assembled into a dovetail slot 20 is determined in one direction, based on the direction in which the locking spacer 100 is mounted in the dovetail slot 20 formed along the outer circumferential surface of a disk 10, an axial direction X, a circumferential direction Y, and a radial direction Z are determined.

The locking spacer 100 of the present disclosure is constituted by several separate parts, and the parts are assembled by being inserted directly into the last remaining space after all blades 30 and spacers 40 are assembled with a dovetail slot 20 through processes shown in FIGS. 1 to 4, thereby forming one locking spacer 100.

As shown in FIG. 5, the locking spacer 100 of the present disclosure includes: a pair of first blocks 110; a pair of second blocks 120; and a locking block 130.

The first blocks 110 are a pair of symmetrical blocks each provided with a dovetail joint 112 having a shape corresponding to a shape of a dovetail surface 25 formed on each of axial direction X opposite sides of the annular dovetail slot 20 formed along the outer circumferential surface of the disk 10. Since the first block 110 is provided with the dovetail joint 112, it is a block that serves to couple the assembled locking spacer 100 to the dovetail slot 20.

The pair of first blocks 110 has a size occupying a portion of the internal space of the dovetail slot 20 because the second blocks 120 and the locking block 130 need a space to be inserted. In other words, when the pair of first blocks 110 are brought into contact with the dovetail surfaces 25 of the dovetail slot 20, the middle portion of the dovetail slot 20 is empty, and the pair of second blocks 120 and the locking block 130 are inserted through the middle space.

The pair of second blocks 120 has a size occupying a portion of the internal space of the dovetail slot 20, the portion not being occupied by the pair of first blocks 110. Accordingly, the locking block 130 can be inserted into the remaining space after the pair of first blocks 110 and the pair of second blocks 120 are inserted into the dovetail slot 20.

Each second block 120 is formed with a concave locking groove 122. The locking groove 122 is provided to allow a locking arm 132 provided in the locking block 130 to be inserted thereinto. Comparing the locking arm 132 and the locking groove 122 to a door lock and a door frame of a general door, it can be understood that they correspond to a deadbolt and a locking groove, respectively. A detailed description thereof will be made, hereinafter.

Herein, the present disclosure is configured such that the first block 110 and the second block 120 are paired on the dovetail surface 25 provided on each of opposite sides of the dovetail slot 20. The reason why the first block 110 and the second block 120 are divided into two blocks is that because it is impossible to assemble the locking spacer through the narrow entrance of the dovetail slot 20 when the block is formed to be thick to form the locking groove 122. Accordingly, the first block 110 including the dovetail joint 112 is fitted on the dovetail surface 25 so that the entrance space for inserting the next block can be sufficiently secured.

The locking block 130 is a part that is finally fitted in the dovetail slot 20 after the pair of first blocks 110 and the pair of second blocks are fitted therein. Accordingly, the locking block 130 has a size to be inserted into a remaining portion of the internal space of the dovetail slot 20, the remaining portion not being occupied by the first and second blocks 110 and 120.

Figure 6:
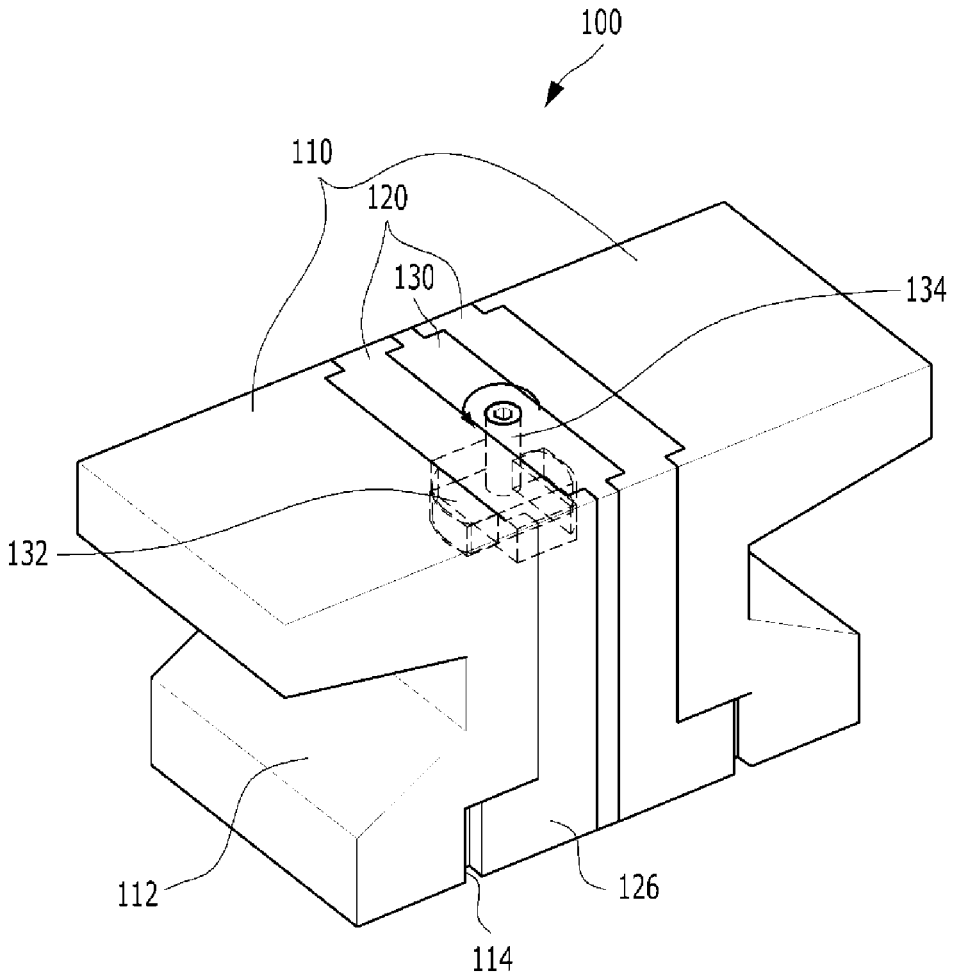
FIG. 6 is a perspective view showing a state where the locking spacer of FIG. 5 is assembled.

Further, the locking arm 132 provided in the locking block 130 serves as a kind of locking device that enters each locking groove 122 of the second blocks 120, with which the opposite end portions of the locking block 130 are brought into contact, by rotation. Referring to FIG. 5, the locking arm 132 is received in the locking block 130 so that it avoids protruding with respect to the locking block 130 before each block is assembled. In this state, after all the blocks are assembled, as shown in FIG. 6, the locking arm 132 is rotated such that the opposite end portions are inserted into associated locking grooves 122, whereby the locking arm 132 functions as a locking device to inhibit the entire locking spacer 100 from separating in the radial direction Z.

When the rotor rotates, a strong centrifugal load is applied to the disk 10 outward in the radial direction Z, and separation of the locking spacer 100 occurs in the radial direction Z, so the locking arm 132 of the locking block 130 can inhibit separation of the locking spacer 100.

Depending on the embodiment, the first block 110 may be provided with an inwardly stepped accommodation portion 114 at a lower surface thereof, and the second block 120 may be provided with a protruding portion 126 at a lower surface thereof to be engaged with the accommodation portion 114. The accommodation portion 114 and the protruding portion 126 are provided to inhibit separation of the second block 120 in the radial direction Z by using the first block 110 fitted on the dovetail surface 25.

Further, the locking spacer 100 of the present disclosure should be fitted in the dovetail slot 20 in the radial direction Z, without a rotating operation, unlike the spacer 40 shown in FIGS. 1 to 4. As a result, sliding contact occurs between the blocks, so it may be desirable to induce the sliding motion to occur correctly.

To achieve this, the first block 110 may be provided with a first guide protrusion 116 on a side opposite to the dovetail joint 112 of axial direction X opposite sides thereof, along the radial direction Z, and the second block 120 may be provided with a first guide groove 128 corresponding to the first guide protrusion 116. Similarly, the second block 120 may be provided with a second guide protrusion 129, and the locking block 130 may be provided with a second guide groove 138 corresponding to the second guide protrusion 129.

Herein, the protruding portion 126 of the second block 120 may be provided with the first guide groove 128, which is advantageous in inhibiting the protruding portion 126 of the second block 120 from causing interference at the narrow entrance of the dovetail slot 20 because the first block 110 and the second block 120 are close to each other by depth of the first guide groove 128 when the second block 120 is inserted with respect to the first block 110.

Further, to facilitate the rotating operation of the locking arm 132, the locking arm 132 disposed inside the locking block 130 may be connected to a rotating rod 134 with a head 136 thereof exposed to an upper surface of the locking block 130. Accordingly, the locking arm 132 can be engaged with or disengaged from the respective locking groove 122 by rotating operation of the rotating rod 134, which is easy to access from the outside.

In the embodiment of the present disclosure shown in the drawings, the rotating rod 134 is a hexagon socket rod. When the rotating rod 134 is formed to be a hexagon socket rod having a hexagon socket therein, it is possible to inhibit disturbance of the normal flow of the fluid acting on a blade 30 from occurring when the head 136 of the rotating rod 134 protrudes outside the locking block 130.

Further, the opposite end portions of the locking arm 132 may be formed to have arc-shaped curved surfaces, and entrances 123 of the locking grooves 122 may be formed to be arc-shaped to correspond to the arc-shaped curved surfaces. This is to inhibit the interference between the end portions of the locking arm 132 and the locking grooves 122 during the rotational movement of the locking arm 132 while securing sufficient strength by maximizing the length and width of the locking arm 132.

Herein, to maximize the locking effect of the locking arm 132, the contact area between the locking arm 132 and the locking grooves 122 should be maximized. The contact area is maximized when the locking arm 132 is at right angle to the second blocks 120. Since it is not easy to identify this state from the outside, it is preferable to provide a means for indicating the position of the locking arm 132.

As an example of the means, each of the locking grooves 122 is provided with a contact surface 124, with which a side surface of the locking arm 132 is brought into contact when the locking arm 132 is at right angle to the second blocks 120. Thanks to the contact surface 124, the locking arm 132 is no longer able to be rotated, whereby a worker can ensure that the locking arm 132 is at right angle to the second blocks 120 only by rotating the locking arm 132 until it does not move.

Another function of the contact surface 124 of the locking groove 122 is to limit the rotational direction of the locking arm 132 only in one direction, that is, toward the entrance 123 of the locking groove 122. In other words, even if the locking arm 132 is attempted to be rotated in the opposite direction, the end portion of the locking arm 132 cannot enter the contact surface 124, so that an erroneous manipulation by a worker turning it in the opposite direction is inhibited.

Figure 7:
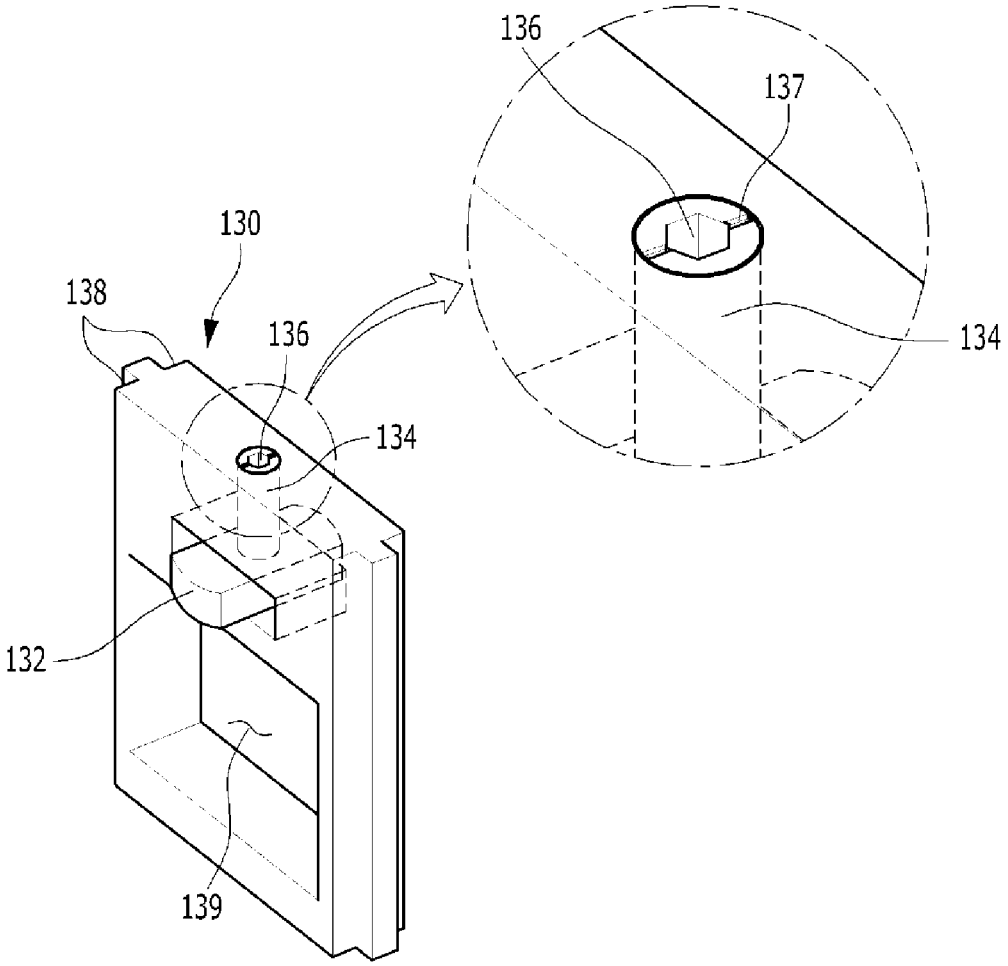
FIG. 7 is an enlarged perspective view showing a locking block.

As another example of the means, the head 136 of the rotating rod 134 exposed to the upper surface of the locking block 130 is provided with an indicator 137 indicating a direction along the opposite end portions of the locking arm 132. The configuration of the indicator 137 is shown in FIG. 7, wherein the indicator 137 of the embodiment is a straight groove formed in the head 136 of the rotating rod 134. Since the worker knows that the direction of the indicator 137 matches the direction of the end portion of the locking arm 132, the position of the locking arm 132 can be identified accurately through the direction of the indicator 137.

Of course, it is possible to use both the contact surface 124 of the locking grooves 122 and the indicator 137 formed in the head 136 of the rotating rod 134.

Meanwhile, since the strong centrifugal load is applied on the locking spacer when the rotor rotates at a high speed, it is preferable to reduce the load. The centrifugal load is ultimately determined by the weight of the locking spacer 100, and therefore it is desirable to make the locking spacer 100 as lightweight as possible.

In consideration of this point, the locking block 130 may be formed with a penetrating portion 139 at a portion of an area thereof without being provided with the locking arm 132. Since the main function of the locking block 130 is to inhibit separation of the locking spacer 100 in the radial direction Z through the locking arm 132, it is possible to remove some of the remaining area except the area provided with the locking arm 132.

Further, the second block 120 and/or the locking block 130 except for the first block 110 provided with the dovetail joint 112 for coupling the dovetail slot 20 may be made of a lightweight titanium material to reduce the overall weight.

The present invention is not necessarily limited to these embodiments, as all of the components constituting the embodiment of the present invention have been described as being combined or operated as a single unit. That is, within the scope of the present invention, all of the components may operate selectively in combination with one or more. It will be further understood that the terms "comprise", "include", "have", etc. when used in this specification, specify the presence of stated features, integers, steps, operations, elements, components, and/or combinations of them but do not preclude the presence or addition of one or more other features, integers, steps, operations, elements, components, and/or combinations thereof. Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

What is claimed is:

1. A locking spacer for a rotor blade, which can be fitted in a dovetail slot provided on an outer circumferential surface of a disk, the locking spacer comprising:

a pair of first blocks occupying a portion of an internal space of the dovetail slot, each first block provided with a dovetail joint configured to engage with the dovetail slot;

a pair of second blocks occupying a portion of the internal space of the dovetail slot other than the portion occupied by the pair of first blocks, each second block provided with a locking groove; and a locking block occupying a portion of the internal space of the dovetail slot other than the portions occupied by the first and second blocks, the locking block provided with a locking arm having opposite end portions respectively configured to be inserted into the locking groove of either of the pair of second blocks, the locking arm configured to rotate about a radial axis of the disk such that the opposite end portions of the rotated locking arm are inserted into the respective locking grooves of the pair of second blocks.

2. The locking spacer of claim 1, wherein each of the first blocks is provided with an inwardly stepped accommodation portion at a lower surface thereof, and each of the second blocks is provided with a protruding portion at a lower surface thereof to be engaged with the accommodation portion.

3. The locking spacer of claim 2, wherein each of the first blocks is provided with a first guide protrusion on a side opposite to the dovetail joint of axial opposite sides thereof along a radial direction, and each of the second blocks is provided with a first guide groove corresponding to the first guide protrusion.

4. The locking spacer of claim 1, wherein each of the second blocks is provided with a second guide protrusion, and the locking block is provided with second guide grooves corresponding to the second guide protrusions.

5. The locking spacer of claim 1, further comprising:

a rotating rod having a first end fixed to the locking arm and a second end extended through an upper surface of the locking block, the rotating arm configured to rotate the locking arm about the radial axis.

6. The locking spacer of claim 5, wherein the rotating rod includes a head that is exposed through the upper surface of the locking block.

7. The locking spacer of claim 6, wherein the rotating rod is a hexagon socket rod.

8. The locking spacer of claim 6, wherein the head of the rotating rod exposed to the upper surface of the locking block includes an indicator indicating a direction along the opposite end portions of the locking arm.

9. The locking spacer of claim 8, wherein the indicator is a straight groove provided in the head of the rotating rod.

10. The locking spacer of claim 1, wherein the opposite end portions of the locking arm are formed to have arc-shaped curved surfaces, and entrances of the locking grooves are formed to be arc-shaped.

11. The locking spacer of claim 10, wherein each of the locking grooves includes a contact surface with which a side surface of the locking arm is brought into contact when the locking arm is angled at 90 degrees with respect to the second blocks.

12. The locking spacer of claim 1, wherein the locking block is provided with a penetrating portion at a portion of an area thereof without being provided with the locking arm.

13. The locking spacer of claim 1, wherein each of the pair of second blocks is made of a titanium material.

14. A blade disk assembly including a blade and a spacer that are configured to be alternately inserted into a dovetail slot provided on an outer circumferential surface of a disk, wherein the blade and the spacer are inserted into the dovetail slot in a state where dovetail joints of both the blade and the spacer are at an angle of 90 degrees to opposite sides of the dovetail slot, and then the blade and the spacer are rotated 90 degrees, such that the dovetail joints are fitted in the dovetail slot, wherein the blade and the spacer are assembled alternately into the dovetail slot one by one, and finally a locking spacer for a rotor blade is engaged in a remaining space of the dovetail slot, and the locking spacer for a rotor blade includes:

a pair of first blocks occupying a portion of an internal space of the dovetail slot, each first block provided with a dovetail joint configured to engage with the dovetail slot;

a pair of second blocks occupying a portion of the internal space of the dovetail slot other than the portion occupied by the pair of first blocks, each second block provided with a locking groove; and a locking block occupying a portion of the internal space of the dovetail slot other than the portions occupied by the first and second blocks, the locking block provided with a locking arm having opposite end portions respectively configured to be inserted into the locking groove of either of the pair of second blocks, the locking arm configured to rotate about a radial axis of the disk such that the opposite end portions of the rotated locking arm are inserted into the respective locking grooves of the pair of second blocks.

15. The blade disk assembly of claim 14, wherein each of the first blocks is provided with an inwardly stepped accommodation portion at a lower surface thereof, and each of the second blocks is provided with a protruding portion at a lower surface thereof to be engaged with the accommodation portion.

16. The blade disk assembly of claim 15, wherein each of the first blocks is provided with a first guide protrusion on a side opposite to the dovetail joint of axial opposite sides thereof along a radial direction, and each of the second blocks is provided with a first guide groove corresponding to the first guide protrusion.

17. The blade disk assembly of claim 16, wherein each of the second blocks is provided with a second guide protrusion, and the locking block is provided with second guide grooves corresponding to the second guide protrusions.

18. The blade disk assembly of claim 14, wherein the opposite end portions of the locking arm are formed to have arc-shaped curved surfaces, entrances of the locking grooves are formed to be arc-shaped, and each of the locking grooves includes a contact surface with which a side surface of the locking arm is brought into contact when the locking arm is angled at 90 degrees with respect to the second blocks.

19. A method for assembling a locking spacer for a rotor blade, in which a blade and a spacer are alternately inserted into a dovetail slot provided on an outer circumferential surface of a disk put on a rotor shaft, wherein the blade and the spacer are inserted into the dovetail slot in a state where dovetail joints of both the blade and the spacer are at an angle of 90 degrees to opposite sides of the dovetail slot, then the blade and the spacer are rotated 90 degrees, such that the dovetail joints are fitted in the dovetail slot, the blade and the spacer are assembled alternately into the dovetail slot one by one, and finally the locking spacer is engaged in a remaining space of the dovetail slot, wherein the locking spacer for the rotor blade comprises:

a pair of first blocks occupying a portion of an internal space of the dovetail slot, each first block provided with a dovetail joint configured to engage with the dovetail slot;

a pair of second blocks occupying a portion of the internal space of the dovetail slot other than the portion occupied by the pair of first blocks, each second block provided with a locking groove; and a locking block occupying a portion of the internal space of the dovetail slot other than the portions occupied by the first and second blocks, the locking block provided with a locking arm having opposite end portions respectively configured to be inserted into the locking groove of either of the pair of second blocks, the locking arm configured to rotate about a radial axis of the disk such that the opposite end portions of the rotated locking arm are inserted into the respective locking grooves of the pair of second blocks, and wherein the method comprises:

engaging the dovetail joint of each of the pair of first blocks with a dovetail surface provided on each of axial opposite sides of the dovetail slot to be fitted thereinto;

inserting the pair of second blocks into the portion of the internal space of the dovetail slot, the portion without being occupied by the pair of first blocks, and bring the first blocks and the second blocks into contact with the dovetail surface;

inserting the locking block into the portion of the internal space of the dovetail slot, the portion without being occupied by the first and second blocks; and inserting the opposite end portions of the locking arm into the locking grooves formed in the pair of second blocks by rotating the locking arm provided in the locking block.

20. The method of claim 19, wherein insertion of the pair of first blocks, the pair of second blocks, and the locking block is performed along a radial direction of the disk without rotating the same.

* * * * *